US010013918B2

(12) United States Patent
Noh et al.

(10) Patent No.: US 10,013,918 B2
(45) Date of Patent: Jul. 3, 2018

(54) ORGANIC LIGHT-EMITTING DIODE DISPLAY DEVICE

(71) Applicant: LG Display Co., Ltd., Seoul (KR)

(72) Inventors: So-Young Noh, Goyang-si (KR); Won-Sang Ryu, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 131 days.

(21) Appl. No.: 14/861,928

(22) Filed: Sep. 22, 2015

(65) Prior Publication Data

US 2016/0086546 A1 Mar. 24, 2016

(30) Foreign Application Priority Data

Sep. 23, 2014 (KR) ..... 10-2014-0126856

(51) Int. Cl.

| | |
|---|---|
| ***G09G 3/3258*** | (2016.01) |
| ***G09G 3/3266*** | (2016.01) |
| ***G09G 3/3291*** | (2016.01) |
| ***G09G 3/3233*** | (2016.01) |

(52) U.S. Cl.

CPC ..... *G09G 3/3258* (2013.01); *G09G 3/3233* (2013.01); *G09G 3/3266* (2013.01); *G09G 3/3291* (2013.01); *G09G 2300/0426* (2013.01); *G09G 2300/0465* (2013.01); *G09G 2300/0814* (2013.01)

(58) Field of Classification Search

CPC ... G09G 2300/0426; G09G 2300/0465; G09G 2300/0814; G09G 3/3233; G09G 3/3258; G09G 3/3266; G09G 3/3291

See application file for complete search history.

(56) References Cited

U.S. PATENT DOCUMENTS

| | | | | |
|---|---|---|---|---|
| 2006/0028410 | A1* | 2/2006 | Kim | G09G 3/3233 345/76 |
| 2006/0038762 | A1* | 2/2006 | Chou | G09G 3/325 345/92 |
| 2011/0279356 | A1 | 11/2011 | Takemura | |
| 2014/0022289 | A1* | 1/2014 | Lee | G09G 3/3283 345/691 |

FOREIGN PATENT DOCUMENTS

| | | |
|---|---|---|
| CN | 103578411 A | 2/2014 |
| JP | 2006-215275 A | 8/2006 |

* cited by examiner

*Primary Examiner* — Viet Pham

(74) *Attorney, Agent, or Firm* — Birch, Stewart, Kolasch & Birch, LLP

(57) ABSTRACT

Discussed is an organic light-emitting diode (OLED) display device for providing a signal to control a transistor and a power voltage to drive an OLED by using one signal line. The device according to an embodiment includes a plurality of gate lines and a plurality of data lines crossing each other to define a plurality of pixels, and a OLED and a pixel driving circuit for independently driving the OLED in each pixel.

10 Claims, 4 Drawing Sheets

ORGANIC LIGHT-EMITTING DIODE DISPLAY DEVICE

This application claims the benefit of Korean Patent Application No. 10-2014-0126856, filed on Sep. 23, 2014, which is hereby incorporated by reference as if fully set forth herein.

BACKGROUND OF THE INVENTION

Field of the Invention

The present invention relates to an organic light-emitting diode (OLED) display device and, more particularly, to an OLED display device for providing a signal to control a transistor and a power voltage to drive an OLED by using one signal line.

Discussion of the Related Art

An organic light-emitting diode (OLED) display device is a self-emissive device for emitting light from an organic emission layer using recombination of electrons and holes and is regarded as a next-generation display device due to a high brightness level, a low driving voltage, and an ultra-thin size thereof.

Each of a plurality of pixels included in the OLED display device includes an OLED including an organic emission layer between an anode and a cathode and a pixel driving circuit for independently driving the OLED. The pixel driving circuit largely includes a switching thin film transistor (TFT), a capacitor, and a driving TFT. The switching TFT charges a voltage corresponding to a data voltage in the capacitor in response to a scan pulse (or gate pulse), and the driving TFT controls the amount of light emitted from the OLED, by controlling the amount of current applied to the OLED depending on the magnitude of the voltage charged in the capacitor. The amount of light emitted from the OLED is proportional to the current applied from the driving TFT.

However, the OLED display device according to a related art has various problems because a plurality of signal lines are provided on a display panel and thus spaces for OLEDs and pixel driving circuits are restricted. Specifically, various signal lines such as data lines, reference lines, power lines, and gate lines are provided on the display panel to cross one another, and regions for the OLEDs and pixel driving circuits are defined at locations where the signal lines cross one another.

Since a plurality of signal lines are provided on a display panel and thus spaces for OLEDs and pixel driving circuits are restricted, the OLED display device according to the related art has problems such as a reduction in aperture ratio, and a reduction in brightness level due to the reduction in aperture ratio.

Also, since a large amount of current is applied to increase the brightness and to compensate for the small aperture ratio, large power consumption or rapid deterioration of the OLEDs is caused.

In addition, the OLEDs may not be provided in a necessary size due to the lack of space, a sufficient amount of current may not be applied to the OLEDs due to the restriction in size, and thus a desired brightness level may not be achieved.

SUMMARY OF THE INVENTION

Accordingly, the present invention is directed to an organic light-emitting diode (OLED) display device that substantially obviates one or more problems due to limitations and disadvantages of the related art.

An object of the present invention is to provide an OLED display device for providing a signal to control a transistor and a power voltage to drive an OLED by using one signal line.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an organic light-emitting diode (OLED) display device display device according to an embodiment of the present invention applies a scan power signal including a scan pulse for turning on a switching thin film transistor (TFT) and a power voltage for allowing an OLED to emit light, to a gate line. If the scan pulse is input, the switching TFT charges a data voltage in a storage capacitor. If a driving TFT is turned on due to the data voltage charged in the capacitor, the driving TFT provides the power voltage of the scan power signal to the OLED to allow the OLED to emit light.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
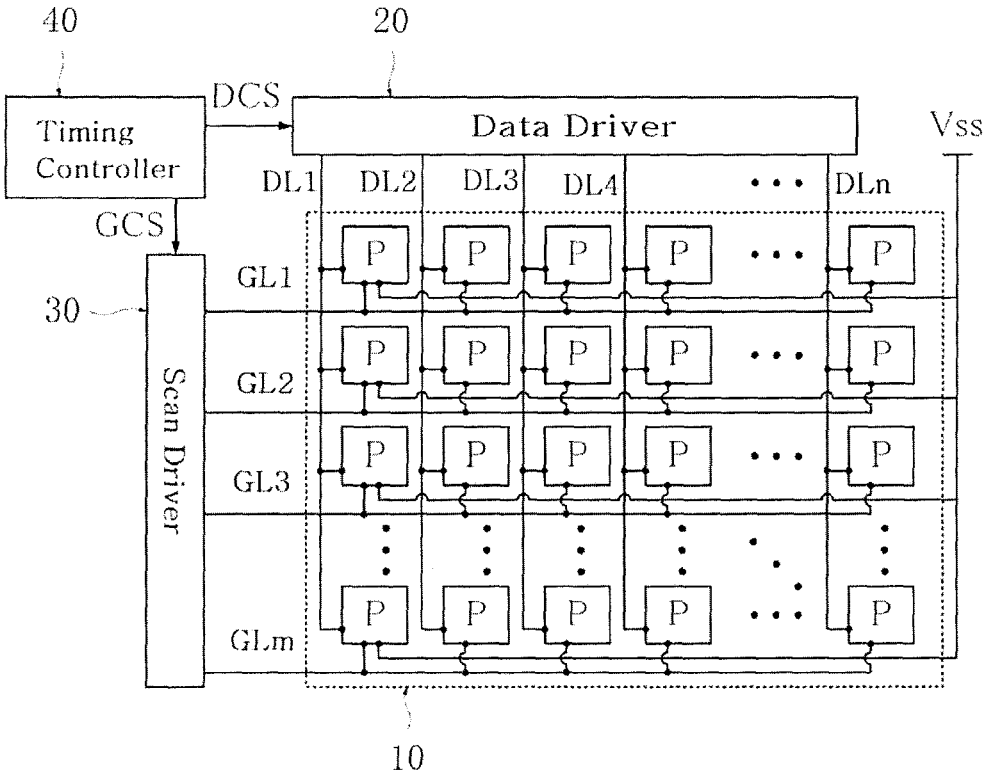
FIG. 1 is a schematic diagram of a pixel driving circuit according to a first embodiment of the present invention.

Hereinafter, the present invention will be described in detail by explaining embodiments of the invention with reference to the attached drawings. Like reference numerals in the drawings denote like elements. In the following description of the present invention, a detailed description of known functions and configurations incorporated herein will be omitted when it may make the subject matter of the present invention unclear. It will be easily understood by one of ordinary skill in the art that some elements of the drawings are exaggerated, reduced, or schematically illustrated for convenience of description and are not always illustrated with appropriate ratios thereof.

Figure 2:
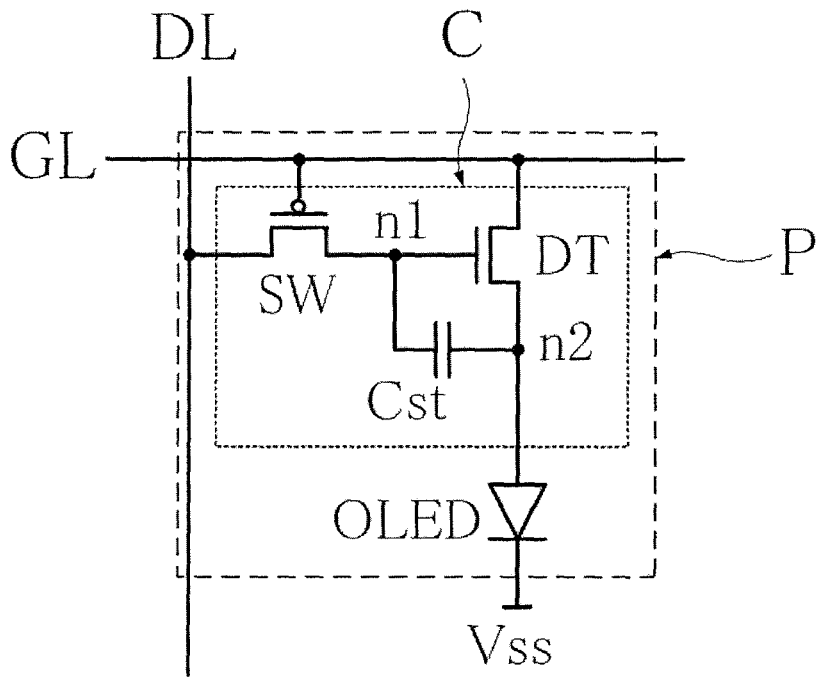
FIG. 2 is an equivalent circuit diagram of two representative pixels of FIG. 1.

FIG. 1 is a schematic diagram of a pixel driving circuit in an OLED display device according to a first embodiment of the present invention, and FIG. 2 is an equivalent circuit diagram of two representative pixels of FIG. 1. The OLED display device in this and other embodiments are operatively coupled and configured.

Referring to FIG. 1, an organic light-emitting diode (OLED) display device is configured to include data lines DL (DL1 to DLn where n is a natural number) provided along a first direction of a display panel 10, gate lines GL (GL1 to GLm where m is a natural number) provided in a vertical direction to the data lines DL, and pixels P in pixel regions defined at locations where the gate lines GL and the data lines DL cross each other. Each of the pixels includes an OLED and a pixel driving circuit for independently driving the corresponding OLED.

The OLED display device according to the first embodiment of the present invention uses the gate lines GL as high-potential power lines or low-potential power lines configured to drive OLEDs, and thus additional power lines are not necessary. Specifically, according to the first embodiment, the high-potential power lines are omitted and the pixel driving circuits are used therefor. That is, according to the general technology, a high-potential power line is provided at each pixel region. However, according to the present invention, only the data lines DL and the gate lines GL are provided between the pixels P. In addition, according to the first embodiment, low-potential power lines (not illustrated in FIG. 1) are connected to cathodes of the OLEDs, but high-potential power lines are not necessary.

The above-described OLED display device according to this embodiment is configured to further include a display panel 10, a data driver 20, a scan driver (or gate driver) 30, and a timing controller 40, and to further include a gamma voltage generator (not shown) and a data processor (not shown).

The timing controller 40 generates and outputs a data control signal DCS and a gate control signal GCS for driving timings of the data driver 20 and the scan driver 30, respectively. Here, the data processor may apply a predetermined compensation value to data input from the outside, and output the compensated input data to the timing controller 40. In addition, the timing controller 40 may determine a peak brightness level based on an average picture level (APL) of the input data and provide the same to the gamma voltage generator, and the gamma voltage generator may generate a gamma voltage set including a plurality of gamma voltages having different levels and provide the same to the data driver 20.

The data driver 20 converts digital data received from the timing controller 40 into analog data voltages and provides the same to the data lines DL of the display panel 10 in response to the data control signal DCS received from the timing controller 40. In this case, a data provider of the data driver 20 subdivides the gamma voltage set received from the gamma voltage generator into gradation voltages individually corresponding to gradation values of data, and then converts the digital data into the analog data voltages using the subdivided gradation voltages. The data driver 20 provides the converted analog data voltages to pixels selected by a scan pulse.

The scan driver 30 sequentially drives the gate lines GL of the display panel 10 in response to the gate control signal GCS received from the timing controller 40. The scan driver 30 provides a scan power signal to each gate line GL in response to the gate control signal GCS. Specifically, the scan driver 30 provides a scan pulse corresponding to a gate on voltage in a gate period of each gate line GL, and provides a high-potential power voltage for driving the OLED as a gate off voltage to the gate lines GL in the other period. As such, each gate line GL provides the scan pulse corresponding to the gate on voltage for controlling driving of a switching thin film transistor (TFT) of the pixel driving circuit in a horizontal cycle for selecting a pixel to receive data input, i.e., a selection period (Se1), and provides the power voltage to the gate lines GL as the gate off voltage in a non-selection period (or emitting period) E1.

The display panel 10 includes the plurality of pixels P. Each pixel P may be a red (R), green (G), or blue (B) pixel or a red (R), green (G), blue (B), or white (W) pixel. However, the colors of the pixels are not limited thereto and are variable. The pixels P are selected due to scan power signals sequentially provided from the scan driver 30 on a line basis as described above, and are charged with analog data voltages Vdata provided from the data driver 20 in the selection period to emit light in an emission period. Specifically, each pixel is selected due to a scan pulse of the scan power signal provided from the scan driver 30 in the selection period Se1, is charged with the data voltage Vdata, and provides the power voltage corresponding to the gate off voltage of the scan power signal, which is provided in the emitting period E1, to an OLED due to the charged data voltage, thereby emitting light.

To this end, each pixel is configured to include a pixel driving circuit C and an OLED as illustrated in FIG. 2, and each pixel driving circuit C is configured to include a driving TFT DT, a switching TFT SW1, and a storage capacitor Cst.

Each switching TFT SW1 includes a gate electrode connected to the corresponding gate line GL, a first electrode connected to the corresponding data line DL, and a second electrode connected to a first node n1. If a scan pulse of a scan power signal is applied to the gate line GL in the selection period, the switching TFT SW1 is turned on due to a gate on voltage of the scan pulse and charges the data voltage Vdata provided through the data line DL in the first node n1. A detailed description of the switching TFT driving method will be given below with reference to FIG. 3. Particularly, the switching TFT SW1 is configured as a TFT which is turned off due to a gate off voltage included in the scan power signal. Specifically, the switching TFT SW1 may be configured as a P-type transistor or N-type transistor. For example, by configuring the switching TFT SW1 as a P-type TFT, a negative voltage may be used as the gate on voltage and a positive first voltage VDD for driving the OLED may also be used as the gate off voltage.

The storage capacitor Cst includes a first electrode connected to a gate electrode of the driving TFT DT corresponding to the first node n1, and a second electrode connected to a first electrode of the OLED corresponding to a second node n2. The first embodiment will be described on the assumption that the first electrode of the OLED is an anode electrode. However, another example is possible. The storage capacitor Cst is charged with the data voltage Vdata provided by the switching TFT SW1 in the selection period, and provides the same as a driving voltage Vgs of the driving TFT DT in the non-selection period corresponding to the emission period.

The driving TFT DT includes a gate electrode connected to the first node n1, a first electrode connected to the second node n2, and a second electrode connected to the gate line GL. In this case, the gate line GL connected to the second electrode of the driving TFT DT may be different from the gate line GL connected to the gate electrode of the switching TFT SW1 included in the same pixel driving circuit. However, the present invention is not limited thereto and the first embodiment will be described on the assumption that the second electrode of the driving TFT DT and the gate electrode of the switching TFT SW1 are connected to the same gate line. In addition, the first electrode and the second electrode of the driving TFT DT serve as a source electrode and a drain electrode depending on a current direction. The driving TFT DT provides a current proportional to the driving voltage Vgs provided from the storage capacitor Cst, through the second node n2 to the OLED to allow the OLED to emit light in the non-selection period corresponding to the emission period. To this end, the driving TFT DT is turned on, receives the gate off voltage provided through the gate line GL, and provides the current to the OLED in the emission period.

The OLED is connected in series with the driving TFT DT between the gate line GL and a second power line VSS. The OLED includes an anode, e.g., a first electrode, connected to the driving TFT DT, a cathode connected to the second power line VSS, and an emission layer provided between the anode and the cathode. The emission layer includes an electron injection layer, an electron transport layer, an organic emission layer, a hole transport layer, and a hole injection layer, which are sequentially stacked on one another between the cathode and the anode. In the OLED, if a positive bias is applied between the anode and the cathode, electrons are provided from the cathode through the electron injection layer and the electron transport layer to the organic emission layer, and holes are provided from the anode through the hole injection layer and the hole transport layer to the organic emission layer. As such, due to recombination of the provided electrons and holes in the organic emission layer, a fluorescent or phosphor material emits light proportional to the amount of current.

As described above, the OLED display device according to the first embodiment of the present invention provides a high-potential power voltage for driving OLEDs through gate lines. As such, by providing a power voltage through the gate lines without configuring additional power lines, a space for the power lines may be utilized for another purpose.

Particularly, in the above-described OLED display device according to the first embodiment, to allow the high-potential power voltage to be provided through the gate lines, the high-potential power voltage provides different negative voltages as a scan pulse, and a P-type TFT which is turned on due to the scan pulse is used as a switching TFT. Although a P-type TFT is used as the switching TFT according to the first embodiment, an N-type TFT may be used to configure the switching TFT, the scan pulse may be provided as a positive voltage, a gate off voltage and a data voltage may be provided as negative voltages, and the driving TFT DT may be configured using a P-type TFT. However, in this configuration, conventional signals need to be converted to opposite polarities and the positions of the anode and cathode of the OLED need to be changed.

Figure 3:
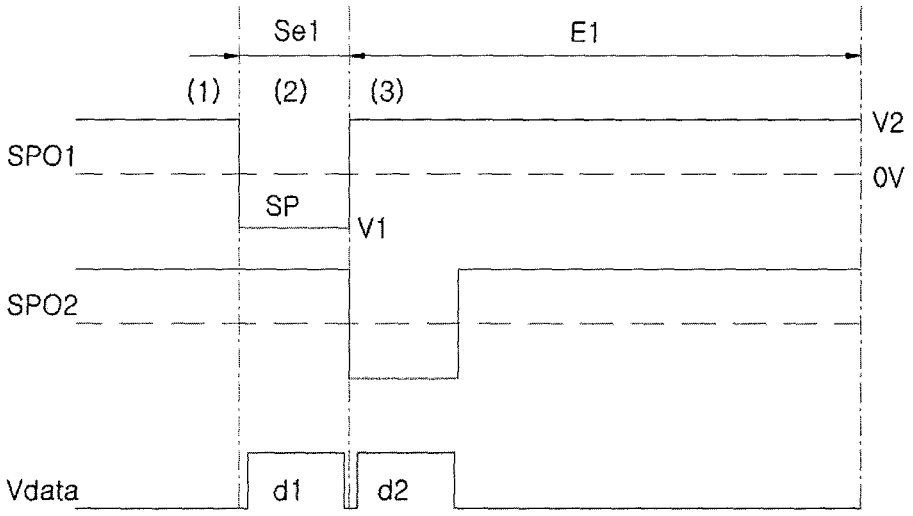
FIG. 3 shows waveforms for driving the OLED display device according to the first embodiment.

FIG. 3 shows waveforms for driving the OLED display device according to the first embodiment.

Referring to FIG. 3, the OLED display device according to the first embodiment of the present invention provides the scan power signal through the gate line GL, and thus controls on/off state of the switching TFT SW1 and provides a power voltage for driving the OLED at the same time.

To this end, as illustrated in FIG. 3, the scan power signal includes a scan pulse SP corresponding to a gate on voltage V1 of the first switching TFT SW1, and a gate off voltage V2 corresponding to a driving power voltage. The scan pulse SP is shifted every horizontal cycle 1H and applied sequentially to the gate lines GL, and the gate off voltage V2 is applied to each gate line GL in a period in which the scan pulse SP is not applied.

Specifically, the scan pulse SP and the gate off voltage V2 are applied to each gate line GL in the selection period and the emission period, respectively. The selection period is given as a time period equal to or shorter than the horizontal cycle 1H, and the scan driver 30 provides the scan pulse SP to the gate line GL in the selection period. The OLED display device emits light in the emission period subsequent to a frame of the selection period.

A description is now given of operation of the pixel P of FIG. 2 due to the scan power signal applied to the first gate line GL1. The gate off voltage V2 corresponding to a positive voltage is provided to the first gate line GL1 in period 1). As such, the first switching TFT SW1 configured as a P-type TFT is maintained in off state due to the gate off voltage V2 corresponding to a positive voltage.

In period 2) corresponding to the selection period, the scan pulse SP corresponding to the negative gate on voltage V1 is applied to the first gate line GL1, and the first switching TFT SW1 is turned on due to the scan pulse SP. In this case, if a first data voltage D1 is provided through the data line DL, the first data voltage D1 is provided to the first node n1 by the turned-on first switching TFT SW1 and thus is charged in the storage capacitor Cst.

In period 3) corresponding to the emission period, the positive gate off voltage V2 is provided to the first gate line GL1 again and the first switching TFT SW1 is turned off. The driving TFT DT is turned on due to the first data voltage D1 charged in the storage capacitor Cst. As the driving TFT DT is turned on, the first gate line GL1 serves as a conventional first power line due to the gate off voltage V2 provided through the first gate line GL1 and the driving TFT DT provides a current required to drive the OLED, to the OLED.

Figure 4:
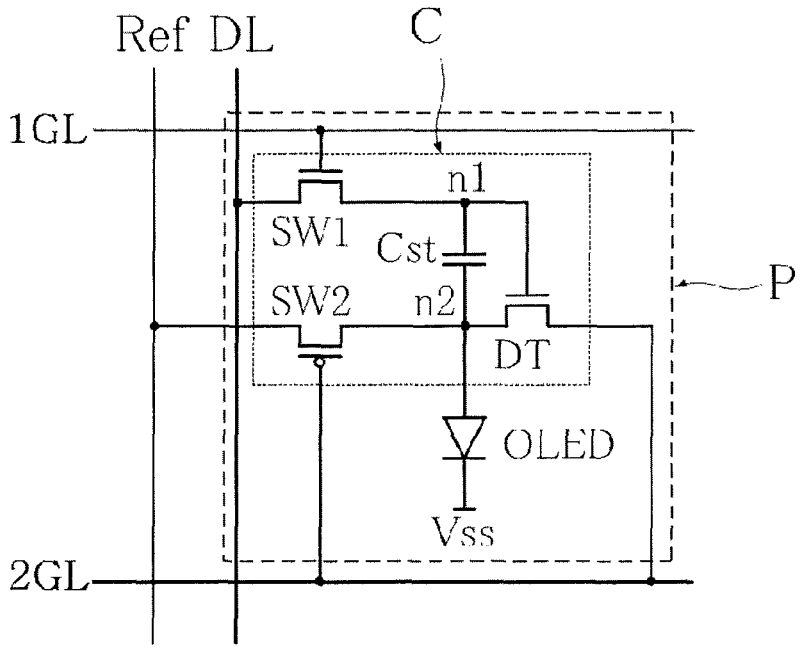
FIG. 4 is a circuit diagram of an OLED display device according to a second embodiment of the present invention.
Figure 5:
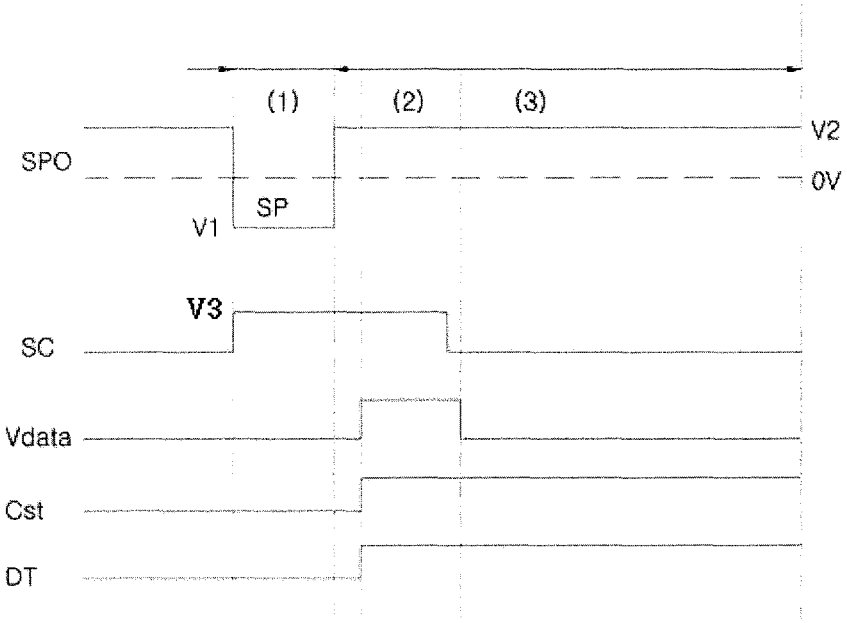
FIG. 5 shows waveforms of driving signals for driving the OLED display device of FIG. 4 according to the second embodiment.

FIG. 4 is a circuit diagram of an OLED display device according to a second embodiment of the present invention. FIG. 5 shows waveforms of driving signals for driving the OLED display device of FIG. 4 according to the second embodiment.

Referring to FIG. 4, compared to the above-described first embodiment, the OLED display device according to the second embodiment of the present invention further includes a reference line Ref for detecting and compensating a threshold voltage Vth of the driving TFT DT, a second switching TFT SW2 connected to the reference line Ref, and a second gate line 2GL for controlling on/off state of the second switching TFT SW2 and providing a power voltage for driving an OLED to emit light. Here, although a scan pulse SP and a power voltage may be provided through a first gate line 1GL connected to a gate electrode of the first switching TFT SW1, the second embodiment will be described on the assumption that the scan pulse and the power voltage are provided to the second gate line 2GL.

The OLED display device according to the second embodiment of the present invention is configured to include the OLED and a pixel driving circuit C, and the pixel driving circuit C is configured to include the driving TFT DT, the first switching TFT SW1, the second switching TFT SW2, and the storage capacitor Cst. The display panel 10 includes the data line DL, the first gate line 1GL, the second gate line 2GL, and the reference line Ref. As illustrated in FIG. 4, the first gate line 1GL and the second gate line 2GL may be provided in parallel to each other by disposing a pixel therebetween, and the data line DL and the reference line Ref may be provided in parallel to each other. In addition to the illustrated form, the location and arrangement of the lines may be changed in various ways. The following description is focused on new or different features compared to the above-described first embodiment.

The first switching TFT SW1 includes a gate electrode connected to the first gate line 1GL, a first electrode connected to the data line DL, and a second electrode connected to the first node n1. The first switching TFT SW1 is turned on or off due to a scan signal provided through the first gate line 1GL and provides a data voltage Vdata provided through the data line DL, to the first node n1.

The second switching TFT SW2 includes a gate electrode connected to the second gate line 2GL, a first electrode connected to the reference line Ref, and a second electrode connected to the second node n2. The second switching TFT SW2 receives a scan power signal SPO provided through the second gate line 2GL and provides a reference voltage Vref received from the reference line Ref, to the second node n2. Specifically, if a scan pulse of the scan power signal is applied to the second gate line 2GL, the second switching TFT SW2 is turned on due to a gate on voltage of the scan pulse and provides the reference voltage Vref received through the reference line Ref, to the second node n2 to initialize the second node n2. Here, the scan power signal provided to the second gate line 2GL includes the gate on voltage corresponding to a negative (−) voltage, and the first power voltage corresponding to a positive (+) gate off voltage. The second switching TFT SW2 is configured as a P-type transistor turned on due to the gate on voltage of the scan power signal. That is, a negative voltage may be used as the gate on voltage by configuring the second switching TFT SW2 as a P-type TFT, and the positive voltage VDD for driving the OLED may also be used as the gate off voltage. As such, a scan pulse for driving the second switching TFT SW2 and a power voltage may be simultaneously provided through the second gate line 2GL.

The storage capacitor Cst includes a first electrode connected to a gate electrode of the driving TFT DT corresponding to the first node n1, and a second electrode connected to the second node n2. After the second electrode of the storage capacitor Cst connected to the second node n2 is initialized due to the reference voltage Vref provided from the second switching TFT SW2, the storage capacitor Cst receives the data voltage Vdata from the first switching TFT SW1 and is charged with a difference voltage between the data voltage Vdata and the reference voltage Vref. The storage capacitor Cst provides the charged difference voltage to the driving TFT DT as the driving voltage Vgs in the emission period.

The driving TFT DT includes a gate electrode connected to the first node n1, a first electrode connected to the second node n2, and a second electrode connected to the second gate line 2GL. The first electrode and the second electrode of the driving TFT DT serve as a source electrode and a drain electrode depending on a current direction. The driving TFT DT is turned on due to the driving voltage Vgs provided from the storage capacitor Cst and provides a current for driving the OLED using the first power voltage provided through the second gate line 2GL.

Referring to FIG. 5, unlike the above-described first embodiment, the OLED display device according to the second embodiment of the present invention is configured to include a pair of the first and second gate lines 1GL and 2GL configured as the gate line GL, and the first and second switching TFTs SW1 and SW2 driven due to scan signals provided through the first and second gate lines 1GL and 2GL, respectively. In particular, according to the second embodiment, the scan power signal is provided through the second gate line 2GL, and thus on/off state of the second switching TFT SW2 is controlled and a power voltage for driving the OLED is provided at the same time.

To this end, a scan power signal SPO, a scan signal SC, and a data voltage Vdata provided to one pixel are shown in FIG. 5. In addition, FIG. 5 also shows a charge period of the storage capacitor Cst and on/off periods of the driving TFT DT.

As illustrated in FIG. 5, the scan power signal SPO includes the scan pulse SP corresponding to the gate on voltage V1 of the second switching TFT SW2 and the gate off voltage V2 corresponding to a driving power voltage. The scan pulse SP is shifted every horizontal cycle 1H and applied sequentially to the second gate lines 2GL, and the gate off voltage V2 is applied to each second gate line 2GL in a period in which the scan pulse SP is not applied.

Specifically, signals applied to the first and second gate lines 1GL and 2GL may differ based on a non-emission period and an emission period, and the emission period may be divided into a selection period and the emission period.

In the non-emission period, as illustrated in FIG. 5, the scan pulse SP of the gate on voltage V1 is applied to the second gate line 2GL and thus the second switching TFT SW2 is turned on, a reference voltage provided through the reference line Ref is provided to the second node n2 by the turned-on second switching TFT SW2.

Meanwhile, in the non-emission period, the scan signal SC of the gate on voltage V3 is also applied to the first gate line 1GL. The first switching TFT SW1 is also turned on due to the scan signal SC of the gate on voltage V3 applied to the first gate line 1GL, but only serves to stabilize the voltage of the first node n1 because a data voltage is not applied.

In the selection period of the emission period, the first power voltage corresponding to a gate off voltage V2 is applied to the second gate line 2GL and thus the second switching TFT SW2 is turned off, and the scan signal SC of the gate on voltage is continuously applied to the first gate line 1GL and thus the first switching TFT SW1 is maintained in on state. In this case, the data voltage Vdata is applied through the data line DL and charged in the storage capacitor Cst through the first switching TFT SW1, and the OLED starts to emit light.

In the emission period, the power voltage corresponding to the gate off voltage V2 is continuously applied to the second gate line 2GL, and a gate off voltage of the scan signal SC is applied to the first gate line 1GL. In this emission period, a difference voltage between the data voltage Vdata charged in the storage capacitor Cst and the reference voltage Vref is provided to the driving TFT DT to turn on the driving TFT DT, and a current due to the power voltage corresponding to a gate off voltage V2 is provided to the OLED and thus the OLED emits light during the on period of the driving TFT DT.

Figure 6:
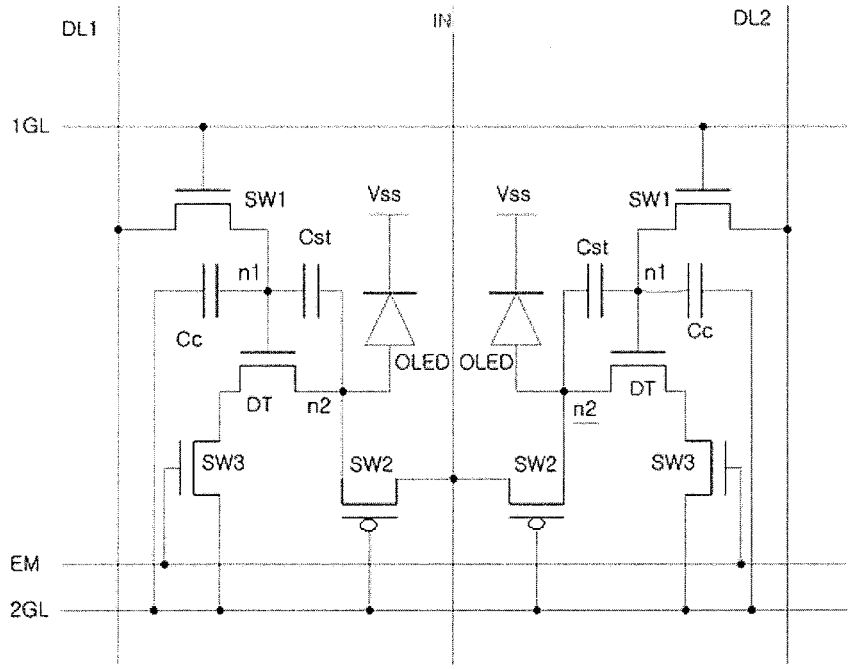
FIG. 6 is a circuit diagram of an OLED display device according to a third embodiment of the present invention.
Figure 7:
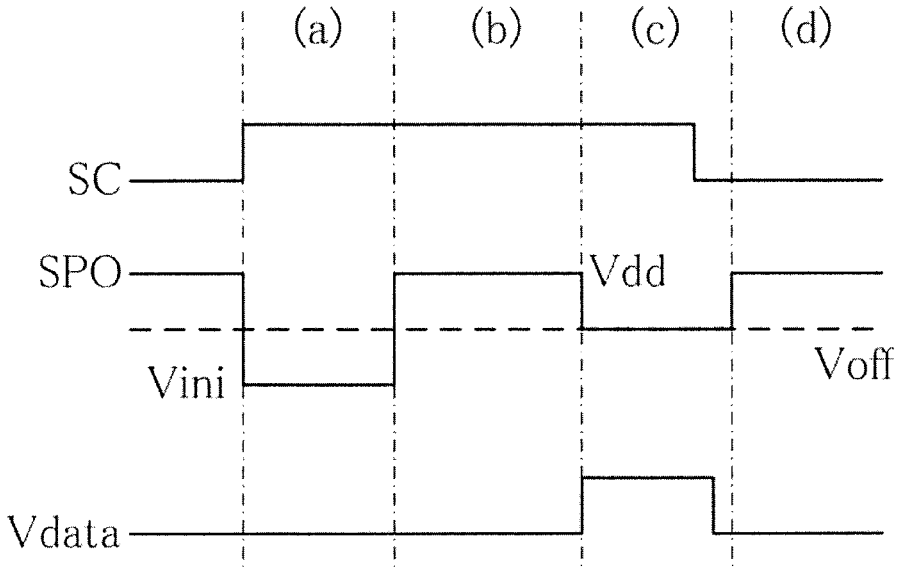
FIG. 7 shows waveforms of driving signals for driving the OLED display device of FIG. 6.

FIG. 6 is a circuit diagram of an OLED display device according to a third embodiment of the present invention. FIG. 7 shows waveforms of driving signals for driving the OLED display device of FIG. 6.

Referring to FIG. 6, the OLED display device according to the third embodiment of the present invention is configured to include data lines DL, an initialization line IN provided in parallel to the data lines DL, first and second gate lines 1GL and 2GL provided to cross the data lines DL, an emission control line EM provided in parallel to the first and second gate lines 1GL and 2GL, and a pixel in a pixel region defined at a location where the data lines DL and the first and second gate lines 1GL and 2GL cross each other. Each of pixels includes an OLED and a pixel driving circuit for independently driving the OLED.

In the OLED display device according to the third embodiment of the present invention, the second gate line 2GL is used to provide a scan power signal for driving control of the second switching TFT SW2, and to provide the power voltage for emission of an OLED.

The pixel of the OLED display device according to the third embodiment of the present invention is configured to include first to third switching TFTs SW1, SW2, and SW3, a driving TFT DT, a storage capacitor Cst, and an auxiliary capacitor Cc.

The first switching TFT SW1 includes a gate electrode connected to the first gate line 1GL, a first electrode connected to the data line DL1, and a second electrode connected to a first node n1. The first switching TFT SW1 is turned on due to a scan signal SC provided through the first gate line 1GL and thus provides a data voltage received through the data line DL1, to the first node n1.

The second switching TFT SW2 includes a gate electrode connected to the second gate line 2GL, a first electrode connected to the initialization line IN, and a second electrode connected to a second node n2. The second switching TFT SW2 receives a scan power signal SPO through the second gate line 2GL and provides an initialization voltage Vini received through the initialization line IN, to the second node n2. Specifically, if a scan pulse SP of the scan power signal SPO is provided to the second gate line 2GL, the second switching TFT SW2 is turned on due to a gate on voltage of the scan pulse SP and provides the initialization voltage Vini received through initialization line IN to the second node n2 to initialize the second node n2. To this end, the second switching TFT SW2 is configured as a P-type TFT which is turned on due to a negative gate on voltage. Here, the scan power signal SPO provided to the second gate line 2GL includes the gate on voltage corresponding to a negative (−) voltage, a power voltage Vdd corresponding to a positive (+) gate off voltage, and an off voltage Voff. A detailed description of the scan power signal SPO and driving using the same will be given below with reference to FIG. 7. Here, the second switching TFT SW2 may be configured in such a manner that the initialization line IN is shared by a pair of pixels as illustrated in FIG. 6. However, the present invention is not limited thereto.

The third switching TFT SW3 includes a gate electrode connected to the emission control line EM, a first electrode connected to the second gate line 2GL, and a second electrode connected to a first electrode of the driving TFT DT. The third switching TFT SW3 is turned on or off due to an emission control signal provided through the emission control line EM and provides the first voltage Vdd applied through the second gate line 2GL to the driving TFT DT. The emission control signal provided through the emission control line EM may be a signal equal to the scan power signal SPO, or a signal including only the first voltage Vdd and the off voltage Voff of the scan power signal SPO.

The storage capacitor Cst includes a first electrode connected to a gate electrode of the driving TFT DT corresponding to the first node n1, and a second electrode connected to the second node n2. In the storage capacitor Cst, the second electrode connected to the second node n2 is initialized due to the initialization voltage Vini provided by the second switching TFT SW2, and a difference voltage between the initialization voltage Vini and a threshold voltage Vth of the driving TFT DT, which is detected due to the first voltage Vdd applied to the first electrode of the the driving TFT DT, is charged in the third switching TFT SW3 which is turned on in a sampling period. The storage capacitor Cst is charged with a difference voltage (Vdata+Vth−Vini) between the initialization voltage Vini and a voltage obtained by compensating the threshold voltage Vth in the data voltage Vdata provided to the first node n1 by the first switching TFT SW1 in a charge period. In an emission period, the storage capacitor Cst provides the difference voltage (Vdata+Vth−Vini) charged in the charge period, to the driving TFT DT to turn on the driving TFT DT, thereby allowing the OLED to emit light.

The auxiliary capacitor Cc includes a first electrode connected to the first node n1, and a second electrode connected to the second gate line 2GL. The auxiliary capacitor Cc may be charged with the data voltage Vdata together with the storage capacitor Cst to provide insufficient capacity of the storage capacitor Cst and to achieve fast and stable charge.

The driving TFT DT includes a gate electrode connected to the first node n1, a first electrode connected to the second electrode of the third switching TFT SW3, and a second electrode connected to the second node n2. The driving TFT DT is turned on due to the voltage charged in the storage capacitor Cst and the auxiliary capacitor Cc in the emission period to provide a current due to the first voltage Vdd provided by the third switching TFT SW3, to the OLED, thereby allowing the OLED to emit light.

Referring to FIG. 7, the OLED display device according to the third embodiment provides the scan power signal SPO for driving control of the second switching TFT SW2 and provides a power voltage for emission of an OLED, using the second gate line 2GL.

Specifically, a scan signal SC, a scan power signal SPO, and a data voltage Vdata are separately provided to the pixel circuit in an initialization period (a), a sampling period (b), a charge period (c), and an emission period (d). Here, FIG. 7 assumes that the scan power signal SPO applied to the second gate line 2GL is also applied to the emission control line EM. However, signals provided to the emission control line EM may apply the first voltage Vdd corresponding to a positive voltage in the sampling period (b) and the emission period (d) and apply the off voltage Voff in the charge period (c).

In the initialization period (a), the scan signal SC of a gate on voltage is applied to the first gate line 1GL and a negative gate on voltage of the scan power signal SPO is applied to the second gate line 2GL and the emission control line EM. As the scan signal SC of the gate on voltage is applied to the first gate line 1GL, the first switching TFT SW1 is turned on and the reference voltage Vref applied to the data line DL is provided to the first node n1 during a data voltage is not applied. In addition, the third switching TFT SW3 is maintained in off state due to the negative gate on voltage applied to the second gate line 2GL and the emission control line EM, and the second switching TFT SW2 is turned on and provides the initialization voltage Vini received through the initialization line IN, to the second node n2 to initialize the second node n2.

In the sampling period (b), the scan signal SC provided to the first gate line 1GL is maintained in the gate on voltage and the first voltage Vdd corresponding to a positive power voltage is applied to the second gate line 2GL and the emission control line EM. As such, the first switching TFT SW1 is maintained in on state and thus the reference voltage Vref is provided to the first node n1. As the positive first voltage Vdd is applied to the emission control line EM and the second gate line 2GL, the second switching TFT SW2 is turned off and the third switching TFT SW3 is turned on. As such, the third switching TFT SW3 provides the first voltage VDD to the first electrode of the driving TFT, and the storage capacitor Cst is charged with a voltage corresponding to the threshold voltage of the driving TFT DT in coupling with the first voltage.

In the charge period (c), the scan signal SC provided to the first gate line 1GL is maintained with the gate on voltage, the off voltage Voff is provided to the second gate line 2GL and the emission control line EM, and the data voltage Vdata is provided through the data line DL. As such, the storage capacitor Cst is charged with the data voltage Vdata in which the pre-charged threshold voltage is compensated.

In the emission period (d), a gate off voltage Voff is applied to the first gate line 1GL and the first voltage Vdd is applied to the second gate line 2GL and the emission control line EM. As such, the driving TFT DT is turned on due to the voltage charged in the storage capacitor Cst and the auxiliary capacitor Cc, and provides a current due to the first voltage Vdd provided by the third switching TFT SW3, to the OLED, thereby allowing the OLED to emit light.

As described above in relation to the first to third embodiments of the present invention, a scan signal for turning on a switching TFT and a power voltage for driving an OLED are simultaneously provided to the switching TFT and a control line connected to the switching TFT. To this end, the switching TFT is configured as a TFT which is turned on due to a voltage having an opposite polarity to the power voltage, and thus may be driven due to a gate on voltage having an opposite polarity to the power voltage for turning on the OLED.

According to the embodiments of the present invention, since a power line for providing a driving power voltage is omitted by providing a signal and the power voltage using a single line, and thus a space for the power line is not necessary, an aperture ratio and a brightness level may be improved, a space for a pixel circuit may be easily ensured, and production costs may be reduced.

Also, since the aperture ratio and the brightness level are improved, a large amount of current to increase the brightness and to compensate for the small aperture ratio is not necessary, the power consumption is decreased and the rapid deterioration of the OLEDs is prevented.

In an OLED display device according to the embodiments of the present invention, since the space for a pixel circuit is easily ensured, the sufficient amount of current may be applied to the OLEDs, and the degree of freedom in design may be increased.

In addition, since a transistor using a signal provided through a single line, as a control signal, and a transistor using the same as a power voltage are configured as opposite types, the signal and the power voltage may be provided using a single line in a simple circuit configuration.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light-emitting diode (OLED) display device comprising:

a data line to which a data voltage is applied;

a reference line to which a reference voltage is applied;

a first gate line to which a scan signal is applied;

a second gate line to which a scan power signal including a scan pulse corresponding to a gate on voltage for a second switching thin film transistor (TFT) and a power voltage corresponding to a gate off voltage for the second switching TFT is applied; and a pixel including an OLED and a pixel driving circuit connected to the data line and the first and second gate lines to drive the OLED, wherein the pixel circuit includes:

a first switching TFT turned on based on the scan signal of the first gate line to provide the data voltage to a first electrode of a storage capacitor;

the second switching TFT turned on based on the scan pulse of the scan power signal to provide the reference voltage to a second electrode of the storage capacitor;

the storage capacitor for charging a difference voltage between the data voltage and the reference voltage and providing the difference voltage to a driving TFT; and the driving TFT for providing the power voltage to the OLED based on the difference voltage to control a current to be provided to the OLED.

2. The OLED display device according to claim 1, wherein a gate electrode, a first electrode, and a second electrode of the first switching TFT are connected to the first gate line, the data line, and a first node, respectively, wherein a gate electrode, a first electrode, and a second electrode of the second switching TFT are connected to the second gate line, the reference line, and a second node, respectively wherein a gate electrode, a first electrode, and a second electrode of the driving TFT are connected to the first node, the second gate line, and the second node, respectively, and wherein the storage capacitor is connected between the first node and the second node.

3. The OLED display device according to claim 1, wherein the second switching TFT is a P-type transistor.

4. The OLED display device according to claim 1, wherein the scan pulse is a negative (−) voltage, and the power voltage is a positive (+) voltage.

5. An organic light-emitting diode (OLED) display device comprising:

a data line to which a data voltage is applied;

an initialization line to which an initialization voltage is applied;

a first gate line to which a scan signal is applied;

an emission control line to which an emission control signal is applied;

a second gate line to which a scan power signal including a scan pulse corresponding to a gate on voltage for a second switching thin film transistor (TFT), a gate off voltage for the second switching TFT, and a power voltage is applied; and a pixel including an OLED and a pixel driving circuit connected to the data line, the initialization line, the emission control line, and the first and second gate lines, wherein the pixel driving circuit includes:

a first switching TFT turned on based on the scan signal of the first gate line to provide the data voltage to a first electrode of a storage capacitor;

the second switching TFT turned on based on the scan pulse of the scan power signal to provide the initialization voltage to a second electrode of the storage capacitor; a third switching TFT turned on based on the emission control signal to provide the power voltage to a driving TFT;

the storage capacitor for charging a difference voltage between the initialization voltage and a voltage obtained by compensating a threshold voltage of the driving TFT in the data voltage and providing the difference voltage to the driving TFT; and the driving TFT for providing the power voltage to the OLED based on the difference voltage to control a current to be provided to the OLED.

6. The OLED display device according to claim 5, wherein two neighboring pixels share the initialization line.

7. The OLED display device according to claim 5, wherein the pixel driving circuit further comprises an auxiliary capacitor connected between the first node and the second gate line.

8. The OLED display device according to claim 5, wherein the scan pulse is applied in a first period of the scan power signal, the power voltage is applied in a second period of the scan power signal, and the gate off voltage is applied in a third period of the scan power signal.

9. The OLED display device according to claim 5, wherein the second switching TFT is a P-type transistor.

10. The OLED display device according to claim 5, wherein the scan pulse is a negative (−) voltage, and the power voltage is a positive (+) voltage.

* * * * *